US011098529B2

(12) United States Patent
Kim

(10) Patent No.: US 11,098,529 B2
(45) Date of Patent: Aug. 24, 2021

(54) CURTAIN FOR ADJUSTING LIGHT TRANSMITTANCE

(71) Applicants: HYUNDAI MOTOR COMPANY, Seoul (KR); KIA MOTORS CORPORATION, Seoul (KR)

(72) Inventor: Jong Won Kim, Cheonan-si (KR)

(73) Assignees: HYUNDAI MOTOR COMPANY, Seoul (KR); KIA MOTOR CORPORATION, Seoul (KR)

( * ) Notice: Subject to any disclaimer, the term of this patent is extended or adjusted under 35 U.S.C. 154(b) by 259 days.

(21) Appl. No.: 16/359,397

(22) Filed: Mar. 20, 2019

(65) Prior Publication Data

US 2020/0181976 A1 Jun. 11, 2020

(30) Foreign Application Priority Data

Dec. 10, 2018 (KR) ..... 10-2018-0158602

(51) Int. Cl.

| | |
|---|---|
| ***E06B 9/42*** | (2006.01) |
| ***E06B 9/66*** | (2006.01) |
| ***E06B 9/386*** | (2006.01) |
| ***E06B 9/264*** | (2006.01) |

(52) U.S. Cl.

CPC ..... *E06B 9/42* (2013.01); *E06B 9/264* (2013.01); *E06B 9/386* (2013.01); *E06B 9/66* (2013.01)

(58) Field of Classification Search

CPC ... E06B 9/40; E06B 9/42; E06B 9/264; E06B 9/66; E06B 2009/425; E06B 9/76; E06B 2009/2405; E06B 2009/2482; B60J 1/2011; B60J 1/2063; B60J 7/0015; B60J 1/2013; B60J 1/2016; B60J 1/203

See application file for complete search history.

(56) References Cited

U.S. PATENT DOCUMENTS

| | | | | |
|---|---|---|---|---|
| 8,960,259 | B2 * | 2/2015 | Weston | F24F 13/082 160/290.1 |
| 10,590,699 | B2 * | 3/2020 | Chen | E06B 9/322 |
| 2015/0247267 | A1 * | 9/2015 | Corey | D03D 19/00 29/897.31 |

* cited by examiner

*Primary Examiner* — Catherine A Kelly
*Assistant Examiner* — Jeremy C Ramsey
(74) *Attorney, Agent, or Firm* — Morgan, Lewis & Bockius LLP

(57) ABSTRACT

A curtain may include a blind shade stretched or contracted in a first direction to adjust transmittance of light, a base coupled to one end portion of the blind shade in the first direction thereof, and a transmittance adjusting device to adjust the transmittance of the light passing through the blind shade by pulling outward or releasing inward an other end portion of the blind shade in the first direction thereof, in the state that spacing from the base in the first direction is fixed.

15 Claims, 9 Drawing Sheets

CURTAIN FOR ADJUSTING LIGHT TRANSMITTANCE

CROSS-REFERENCE TO RELATED APPLICATION

The present application claims priority to Korean Patent Application No. 10-2018-0158602, filed on Dec. 10, 2018, the entire contents of which is incorporated herein for all purposes by this reference.

BACKGROUND OF THE INVENTION

Field of the Invention

The present invention relates to a curtain for a vehicle.

Description of Related Art

In general, since a door curtain used for a vehicle door is made of a single sheet of fabric, the door curtain may not adjust the transmittance of light.

Although two sheets of curtains overlap with each other to adjust the transmittance of the light to solve the above inconvenience, the problem related to the layout may be caused by the thickness of the curtains and the raw material costs may be increased.

In other words, although there is suggested a manner of allowing an electronic film to stick to the window of the door to electronically control the transmittance of light passing through the electronic film, the present manner may not be applied to mass-production vehicles due to costs.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a curtain for adjusting the transmittance of light.

The technical problems to be solved by the present inventive concept are not limited to the aforementioned problems, and any other technical problems not mentioned herein will be clearly understood from the following description by those skilled in the art to which the present invention pertains.

According to various aspects of the present invention, a curtain may include a blind shade stretched or contracted in a first direction to adjust transmittance of light, a base coupled to one end portion of the blind shade in the first direction thereof, and a transmittance adjusting device to adjust the transmittance of the light passing through the blind shade by pulling outward or releasing inward an other end portion of the blind shade in the first direction thereof, in a state that spacing from the base is fixed in the first direction thereof.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
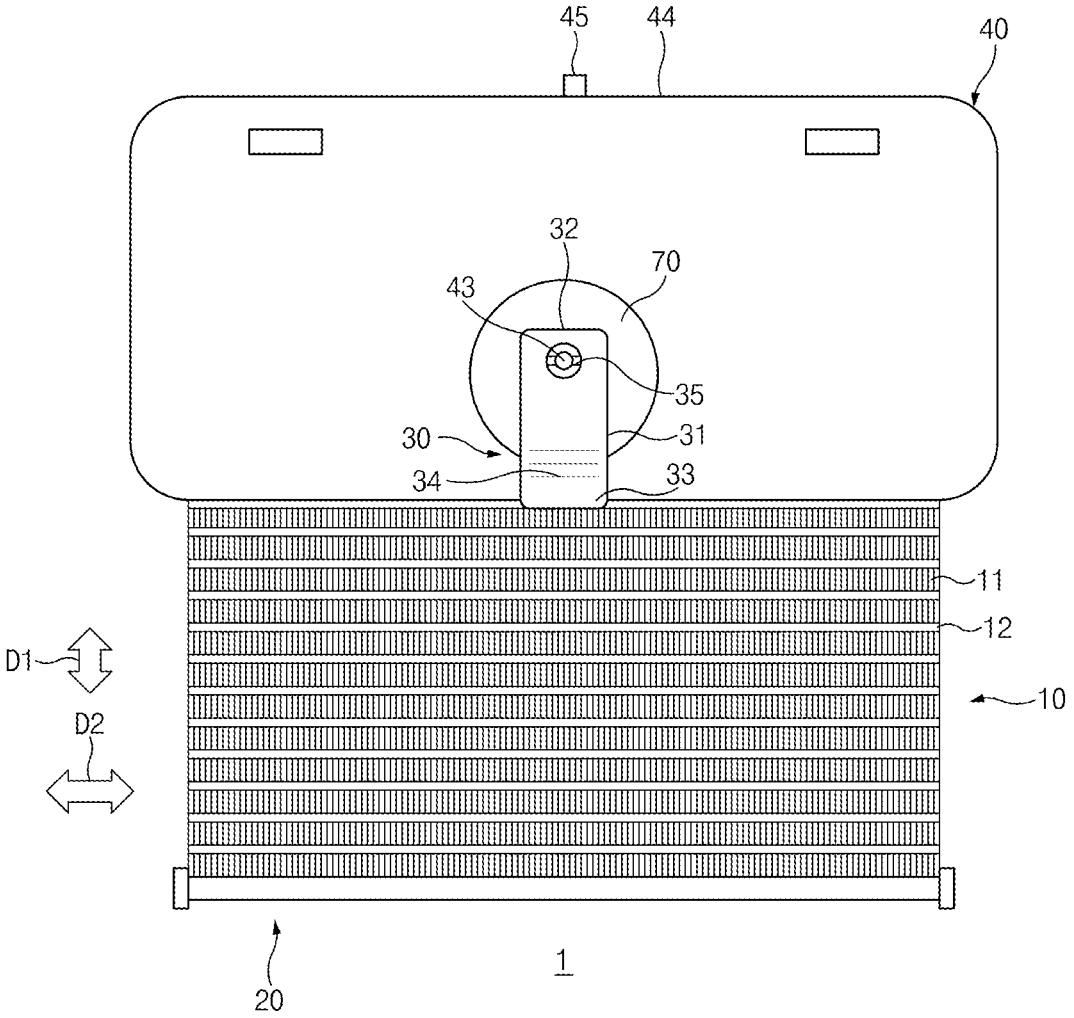
FIG. 1 is a front view exemplarily illustrating a curtain, according to an exemplary embodiment of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments of the present invention, it will be understood that the present description is not intended to limit the invention(s) to those exemplary embodiments. On the other hand, the invention(s) is/are intended to cover not only the exemplary embodiments of the present invention, but also various alternatives, modifications, equivalents and other embodiments, which may be included within the spirit and scope of the invention as defined by the appended claims.

Hereinafter, various exemplary embodiments of the present invention will be described in detail with reference to accompanying drawings. In the following description, the same reference numerals will be assigned to the same components even though the components are illustrated in different drawings. Furthermore, in the following description, a detailed description of well-known features or functions will be ruled out in order not to unnecessarily obscure the gist of the present invention.

In the following description of components according to an exemplary embodiment of the present invention, the terms "first", "second", 'A', 'B', '(a)', and '(b)' may be used. The terms are used only to distinguish relevant components from other components, and the nature, the order, or the sequence of the relevant components is not limited to the terms. When a certain component is "linked to", "coupled to", or "connected with" another component, the certain component may be directly linked to or connected to the another component, and a third component may be "linked", "coupled", or "connected" between the certain component and the another component.

Figure 2:
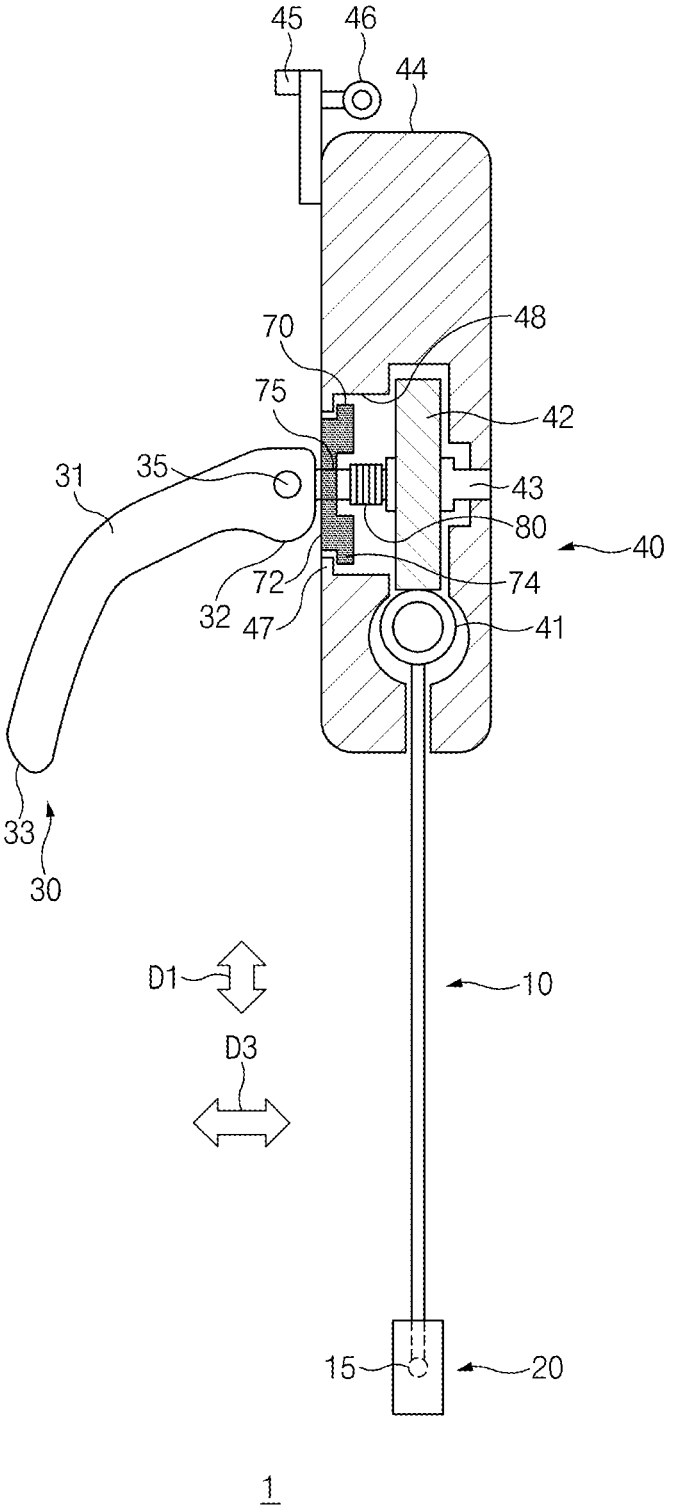
FIG. 2 is a longitudinal sectional view of the curtain when viewed from the side, according to an exemplary embodiment of the present invention.
Figure 3:
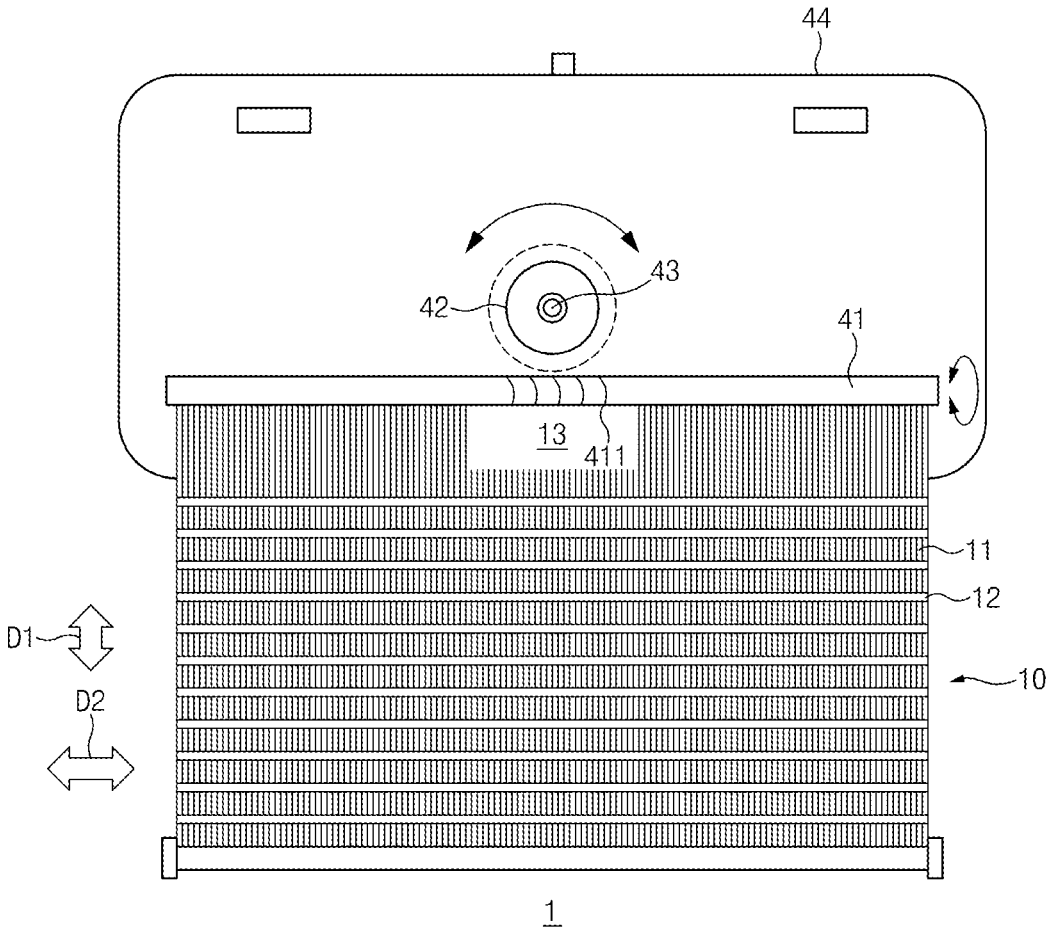
FIG. 3 is a longitudinal sectional view of the curtain when viewed from the front, according to an exemplary embodiment of the present invention.

FIG. 1 is a front view exemplarily illustrating a curtain 1, according to an exemplary embodiment of the disclosure, FIG. 2 is a longitudinal sectional view of the curtain 1 when viewed from the side, according to an exemplary embodiment of the present invention, and FIG. 3 is a longitudinal sectional view of the curtain 1 when viewed from the front, according to an exemplary embodiment of the present invention.

Referring to the drawings, according to an exemplary embodiment of the present invention, the curtain 1 includes a blind shade 10, a base 20, and a transmittance adjusting device 40. The curtain 1 may further include a knob 30, a fixing device, and a return device 80.

Blind Shade 10

The blind shade 10 is a component formed to adjust the transmittance of light passing through the blind shade 10. The blind shade 10 may adjust the transmittance of the light passing through the blind shade 10 by extending in a first direction D1. The first direction D1, which is a specific direction, is illustrated as a lengthwise direction on the drawings.

To extend in the first direction D1, opposite end portions of the blind shade 10 are hold to be pulled or released with respect to the first direction D1 to return to an original state thereof, by different components. One of the opposite end portions of the blind shade 10 is linked to the base 20 to be described below and another end portion of the blind shade 10 is linked to the transmittance adjusting device 40 to be described below.

The blind shade 10 may be formed by weaving a first shading member 11 and a second shading member 12 crossing the first shading member 11. As first shading members 11 and second shading members 12 are woven, the first shading members 11 may extend in the first direction D1 and may be disposed in a second direction D2 perpendicular to the first direction D1. On the other hand to this, the second shading members 12 may extend in the second direction D2, and may be disposed in the first direction D1.

Since the first shading member 11 is formed of a material extensible in the first direction D1, the first shading member 11 may extend in the first direction D1. In detail, the first shading member 11 may include fiber formed of spandex and nylon, and the second shading member 12 may include fiber formed of nylon. Accordingly, the first shading member 11 may have elasticity greater than that of the second shading member 12.

Since the blind shade 10 is formed as the first shading member 11 and the second shading member 12 are woven to cross each other, a region having only one of the first shading member 11 and the second shading member 12 has light transmittance greater than that of the cross region between the first shading member 11 and the second shading member 12. Furthermore, when the first shading member 11 is stretched by pulling the blind shade 10 in the first direction D1, the spacing between two adjacent second shading members 12 is increased. Accordingly, as a region having only the first shading member 11 is increased, the whole transmittance of light passing through the blind shade 10 may be increased. As the degree of stretching the first shading member 11 in the first direction D1 is increased, the transmittance of light passing through the blind shade 10 may be increased.

The transmittance of the light passing through the blind shade 10 may be reduced by recovering the blind shade 10, which has been stretched, to reduce the degree of stretching the blind shade 10. This is because the size of the region having only the first shading member 11 is reduced as the spacing between the second shading members 12 is reduced in the first direction D1.

The blind shade 10 may be wound around an external surface of an adjusting rod 41 to be described below or wound around an external surface of a roller rod 15 to be described below, depending on the operation of the adjusting rod 41.

Base 20

The base 20 is a component coupled to one of opposite end portions of the blind shade 10 with respect to the first direction D1. The base 20 is coupled to the frame of a door 90 to be described below, so that the position of the base 20 is fixed. Therefore, even if the blind shade 10 is stretched in the first direction D1 by the transmittance adjusting device 40 to be described below, the one end portion of the blind shade 10 coupled to the base 20 is not moved, but allows the blind shade 10 to be stretched or unfolded in the first direction D1.

The blind shade 10 may be received in the base 20. The base 20 may include a roller rod 15 allowing the blind shade 10 to be wound around the external surface of the roller rod 15. Accordingly, as the roller rod 15 is rotated, the blind shade 10 may be wound around the external surface of the roller rod 15 and received in the base 20. The one end portion of the blind shade 10 may be coupled to the roller rod 15, but the blind shade 10 may be folded or wrinkled while being received in the base 20.

Transmittance Adjusting Device 40

The transmittance adjusting device 40 is a component to stretch or release the blind shade 10 in the first direction D1, adjusting the transmittance of light passing through the blind shade 10. In the state that the spacing between the transmittance adjusting device 40 and the base 20 in the first direction D1 is fixed, the transmittance adjusting device 40 pulls or releases an other end portion of the blind shade 10, which is positioned in opposition to the one end portion of the blind shade 10 coupled to the base 20, outward or inward in the first direction D1, adjusting the transmittance of light passing through the blind shade 10. Accordingly, the other end portion of the blind shade 10 may be coupled to the transmittance adjusting device 40.

The transmittance adjusting device 40 may pull the blind shade 10 by rolling the blind shade 10. The transmittance adjusting device 40 may include the adjusting rod 41 extending in a specific direction and linked to at least a portion of the other end portion of the blind shade 10. In the instant case, the specific direction may be the second direction D2. As the adjusting rod 41 rotates in one direction while employing the second direction D2 as an axial direction thereof, a region of the blind shade 10, which is adjacent to the other end portion of the blind shade 10, may be wound around an external surface of the adjusting rod 41. While the region adjacent to the other end portion of the blind shade 10 is rolled, the one end portion of the blind shade 10 is fixed by the base 20. Accordingly, the opposite end portions of the blind shade 10 are stretched outward by the adjusting rod 41 and the base 20. Therefore, the blind shade 10 is stretched in the first direction D1.

To the contrary, the wound blind shade 10 may be released by rotating the adjusting rod 41 in a direction opposite to the direction described above in the state that the region of the blind shade 10 adjacent to the other end portion of the blind shade 10 is wound around the external surface of the adjusting rod 41. Accordingly, as the degree that the blind shade 10 is stretched outward in the first direction D1 is reduced, the blind shade 10 is contracted in the first direction D1.

A partial region of the external surface of the adjusting rod 41 is a screw region 411, and a thread is formed in a spiral shape in the screw region 411. However, gear teeth may be formed in the screw region 411 instead of the thread.

The other end portion of the blind shade 10 may be coupled to a remaining region of the external surface of the adjusting rod 41 other than the screw region 411 such that the other end portion of the blind shade 10 is not wound around the screw region 411 when the adjusting rod 41 is rotated. Accordingly, a portion of the other end portion of the blind shade 10, which corresponds to the screw region 411, is not coupled to the adjusting rod 41, but spaced from the adjusting rod 41, forming an open region 13 between the portion of the other end portion of the blind shade 10 and the adjusting rod 41 as illustrated in FIG. 3. Since the open region 13 is formed, as the adjusting rod 41 is rotated, when the remaining region of the blind shade 10 adjacent to the other end portion of the blind shade 10 is wound around the external surface of the adjusting rod 41, the portion of the other end portion of the blind shade 10, which corresponds to the screw region 411, may not be wound around the external surface of the adjusting rod 41.

The transmittance adjusting device 40 may further include a wheel 42. The wheel 42 is engaged with the screw region 411 of the adjusting rod 41 to rotate in a specific direction thereof. When the thread in the spiral shape is formed in the screw region 411 of the adjusting rod 41, gear teeth may be formed in the external surface of the wheel 42 and engaged with the thread to rotate while employing a third direction D3 as an axial direction thereof, perpendicularly to the first direction D1 and the second direction D2. In other words, the adjusting rod 41 and the wheel 42 act as a worm gear and a worm wheel, respectively. The gear tooth of the wheel 42 is marked in a dotted line in the drawing. When the gear teeth are formed in the screw region 411 of the adjusting rod 41, the gear teeth of the wheel 42 may be engaged with the gear teeth of the screw region 411 to rotate while employing the second direction D2 as an axial direction thereof. According to an exemplary embodiment of the present invention, the following description will be made while focusing on that the thread is formed in the screw region 411, and the wheel 42 rotates while employing the third direction D3 as an axial direction thereof.

As the wheel 42 rotates while employing the third direction D3 as an axial direction thereof, the adjusting rod 41 rotates while employing the second direction D2 as an axial direction thereof. When the adjusting rod 41 rotates, the blind shade 10 is contracted. Accordingly, as the wheel 42 rotates, the blind shade 10 may be contracted.

The transmittance adjusting device 40 may further include an adjusting device body 44 including an adjusting device ring 46 coupled to a frame ring 931 formed on the frame of the door 90. The wheel 42 and the adjusting rod 41 are received and fixed inside the adjusting device body 44.

The adjusting device body 44 may further include a body grip portion 45, and, as a user grips and moves the body grip portion 45, the adjusting device body 44 may move in the first direction D1. As the adjusting device body 44 moves in the first direction D1 and the adjusting device ring 46 is coupled to the frame ring 931 formed on the frame of the door 90, the mounting of the curtain 1 is completed, and the spacing between the base 20 and the transmittance adjusting device 40 in the first direction D1 may be fixed.

Knob 30

The knob 30 is a component coupled to the wheel 42 to rotate the wheel 42. The knob 30 rotates the wheel 42 to adjust the transmittance of light through the blind shade 10. To rotate the wheel 42, the knob 30 is coupled to a wheel shaft 43 provided as an axial axis of the wheel 42.

One end portion 32 of the knob 30 is positioned adjacent to the transmittance adjusting device 40 such that a rotation shaft 35 of the knob 30 is connected to the wheel shaft 43 in a space defined inside the knob 30. The rotation shaft 35 of the knob 30, which is a component provided as an axial axis of the knob 30, is inserted into a through hole formed in the wheel shaft 43 and adjacent to the end portion of the knob 30 such that the wheel shaft 43 may be disposed in a direction perpendicular to the third direction D3. Accordingly, the knob 30 may rotate about the wheel shaft 43 provided as a rotation axis while employing the direction perpendicular to the third direction D3 as an axial direction thereof.

The shape of one end portion 32 of the knob 30 may be formed such that the distance from the rotation shaft 35 of the knob 30 to a boundary, which is positioned in the third direction D3 and faces the transmittance adjusting device 40, of the one end portion 32 of the knob 30 is not equal to the distance from the rotation shaft 35 of the knob 30 to a boundary, which is positioned in the first direction D1 and faces the lower portion of the drawing, of the one end portion 32 of the knob 30, when viewed in the second direction D2 which is an extending direction of the rotation shaft 35 of the knob 30 in the state that the knob 30 is disposed as illustrated in FIG. 2. In the instant case, the distance from the rotation shaft 35 of the knob 30 to the boundary, which is positioned in the first direction D1, of the one end portion 32 of the knob 30 may be longer than the distance from the rotation shaft 35 of the knob 30 to the boundary, which is positioned in the third direction D3, of one end portion 32 of the knob 30.

A non-slip structure 34 may be formed at a region of the knob 30 adjacent to an other end portion 33 of the knob 30 to prevent a user hand from slipping from the knob 30 when a user grips and utilizes the knob 30. The non-slip structure 34 may have roughness. The one end portion 32 and the other end portion 33 of the knob 30 are connected to each other by a body 31. The body 31 of the knob 30 has the shape curved which is in a direction away from the wheel 42 as in FIG. 2.

The knob 30 may selectively press a fixing portion 70 of the fixing device, which is to be described below, such that the fixing portion 70 makes contact with the wheel 42 or spaced from the wheel 42. Since the knob 30 rotates about the rotation shaft 35 of the knob 30, the knob 30 may press the fixing portion 70 by rotating while employing the direction perpendicular to the third direction D3 as an axial direction thereof. Since the one end portion 32 of the knob 30 is formed in the above-described manner, as the knob 30 rotates, the knob 30 may press the fixing portion 70 or may be spaced from the fixing portion 70. The detailed structure of pressing the fixing portion 70 will be described with reference to FIG. 8 and FIG. 9.

Fixing Portion 70

The fixing portion 70 is a component which selectively makes contact with the wheel 42 to block the rotation of the wheel 42 or allow the rotation of the wheel 42 mounted in a mounting groove 48 formed in the adjusting device body 44. The fixing portion 70 is formed in an annular shape such that the wheel shaft 43 passes through the opening 75 formed at the center portion of the fixing portion 70.

The fixing portion 70 may make contact with the wheel 42 by pushing the knob 30. The knob 30 may press the fixing portion 70 in the third direction D3 such that the fixing portion 70 moves in the third direction D3 to make contact with the wheel 42, blocking the rotation of the wheel 42 due to friction.

The fixing portion 70 may include a rubber pad to prevent the wheel 42 from being damaged when the fixing portion 70 makes contact with the wheel 42. Even when the one end portion 32 of the knob 30 makes contact with the fixing portion 70 to press the fixing portion 70, the knob 30 may be prevented from being damaged.

The fixing portion 70 may include a plastic O-ring to be placed in an opening 75 in the center portion of the fixing portion 70, preventing the wheel shaft 43 from being damaged and the rotation of the wheel shaft 43 from being interrupted.

The fixing portion 70 may be formed in an annular shape, and may be formed by stacking a first annular member 72 having a smaller external diameter on a second annular member 74 having a larger external diameter. Therefore, the second annular member 74, which is disposed in the fixing portion 70, having the larger diameter is locked to a step 47 formed on the adjusting device body 44 to prevent the fixing portion 70 from being out of the adjusting device body 44.

Return Device 80

When the external force exerted on the fixing portion 70 toward the wheel 42 is released, and the fixing portion 70 is separated from the wheel 42, the wheel 42 may rotate again to pull or release the blind shade 10. Therefore, according to an exemplary embodiment of the present invention, the curtain 1 may further include a return device 80 to apply external force to the fixing portion 70 in the direction away from the wheel 42, such that the fixing portion 70 may be separated from the wheel 42.

The return device 80 is an elastic member to apply resilience force to the fixing portion 70 in the direction that the fixing portion 70 is separated from the wheel 42, as the return device 80 is elastically deformed when the fixing portion 70 is pressed to make contact with the wheel 42. According to an exemplary embodiment of the present invention, the return device 80 is a spring located between the fixing portion 70 and the wheel 42 and having one end portion connected to the flange of the wheel shaft 43 and an other end portion making contact with the fixing portion 70 when the fixing portion 70 is pressed. Accordingly, when the fixing portion 70 is pressed, the return device 80 is compressed to apply the resilience force to the fixing portion 70 in the direction that the fixing portion 70 is separated from the wheel 42. However, when the return device 80 is formed outside the fixing portion 70 and thus the fixing portion 70 is pressed to move toward the wheel 42, the return device 80 may be elongated and thus the same resilience force may be provided to the fixing portion 70.

When the force for pressing the fixing portion 70 toward the wheel 42 is released in a response to the action of the return device 80, only the resilience force remains in the force applied to the fixing portion 70. Therefore, the fixing portion 70 is separated from the wheel 42, and the wheel 42 becomes rotatable again.

The return device 80 may return the wheel 42 to the original state thereof. When the state in which the blind shade 10 is not stretched or contracted is regarded as the original state, the wheel 42 may be rotated to stretch and contract the blind shade 10. In the instant state, when the fixing portion 70 is pressed against the wheel 42 by use of the knob 30, the wheel 42 is not rotated. In the instant case, the return device 80 is fixed in a state deformed due to the rotation of the wheel shaft 43, and applies resilience force to rotate the wheel shaft 43 in the direction opposite to the direction in which the wheel 42 has rotated. Therefore, when the fixing portion 70 is separated from the wheel 42, the wheel 42 is rotated by the resilience force to return to the original state, and the blind shade 10 returns to the original state as the wheel 42 rotates.

For the present operation, the return device 80 may include a torsion spring, but the type thereof is not limited thereto.

Figure 4:
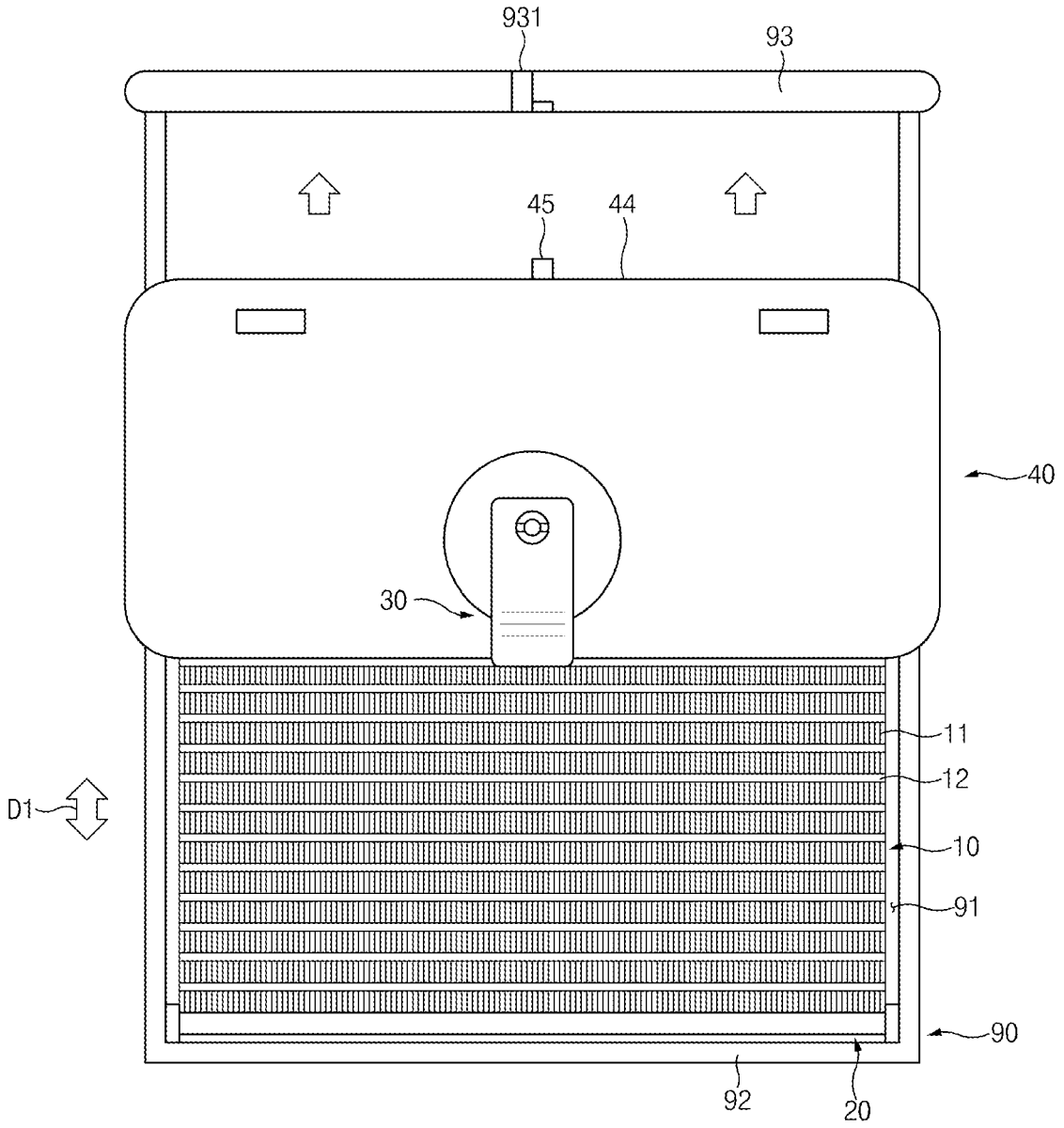
FIG. 4 is a view that the curtain is pulled to cover a door, according to an exemplary embodiment of the present invention.

FIG. 4 is a front view exemplarily illustrating a state that the curtain 1 is pulled to shade the door 90, according to the exemplary embodiment of the present invention.

According to an exemplary embodiment of the present invention, the curtain 1 may be mounted on the door 90. The door 90 may include a window 91 and a frame of the door 90 surrounding the window 91. The frame of the door 90 may include a first frame 92 and a second frame 93 spaced from each other in the first direction D1. According to an exemplary embodiment of the present invention, the frame of the door 90 is formed in a rectangular shape, and the first frame 92 is disposed on the lower portion and the second frame 93 is disposed on the upper portion. However, the arrangement thereof is not limited thereto.

The base 20 may be fixed to the first frame 92. The user grips the body grip portion 45 and pulls the body grip portion 45 away from the base 20 in the first direction D1 in the state in which the base 20 is fixed. Therefore, the blind shade 10 wound around the roller rod 15 is unfolded by moving the transmittance adjusting device 40 away from the base 20 in the first direction D1.

When the adjusting device body 44 reaches the second frame 93, the user engages the adjusting device ring 46 with the frame ring 931 by hanging the adjusting device ring 46 on the frame ring 931 formed on the second frame 93. Accordingly, the distance between the base 20 and the transmittance adjusting device 40 is fixed.

Figure 5:
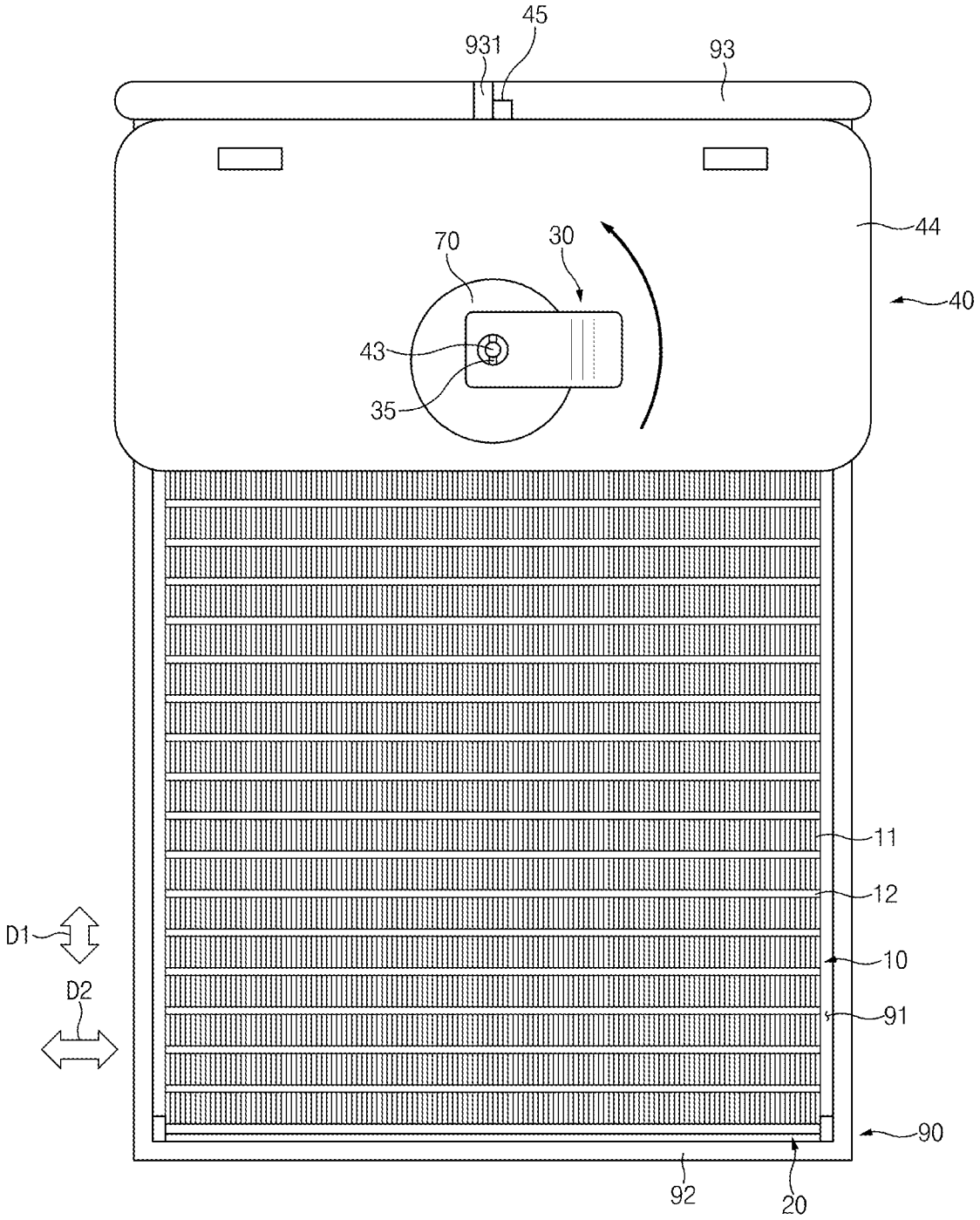
FIG. 5 is a front view exemplarily illustrating that a blind shade is extended after the curtain is fixed, according to an exemplary embodiment of the present invention.
Figure 6:
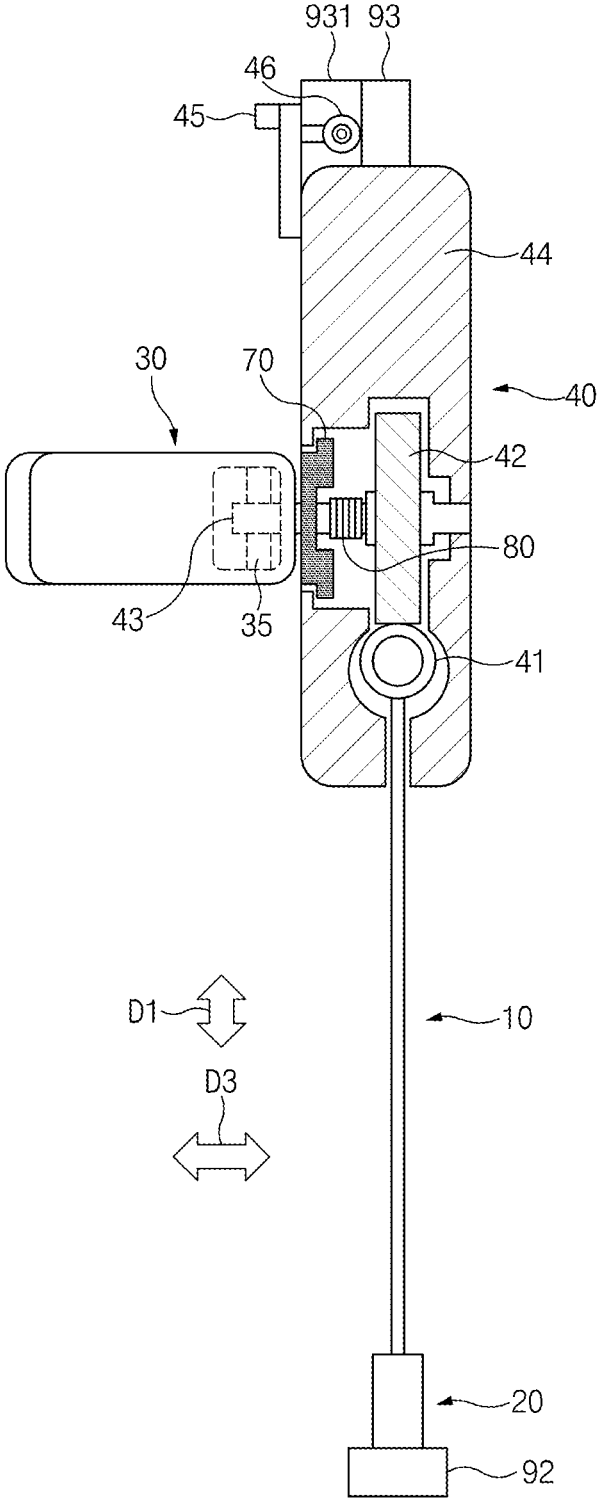
FIG. 6 is a longitudinal sectional view of the curtain when viewed from the side in the state that the blind shade is stretched after the curtain is fixed, according to the exemplary embodiment of the present invention.
Figure 7:
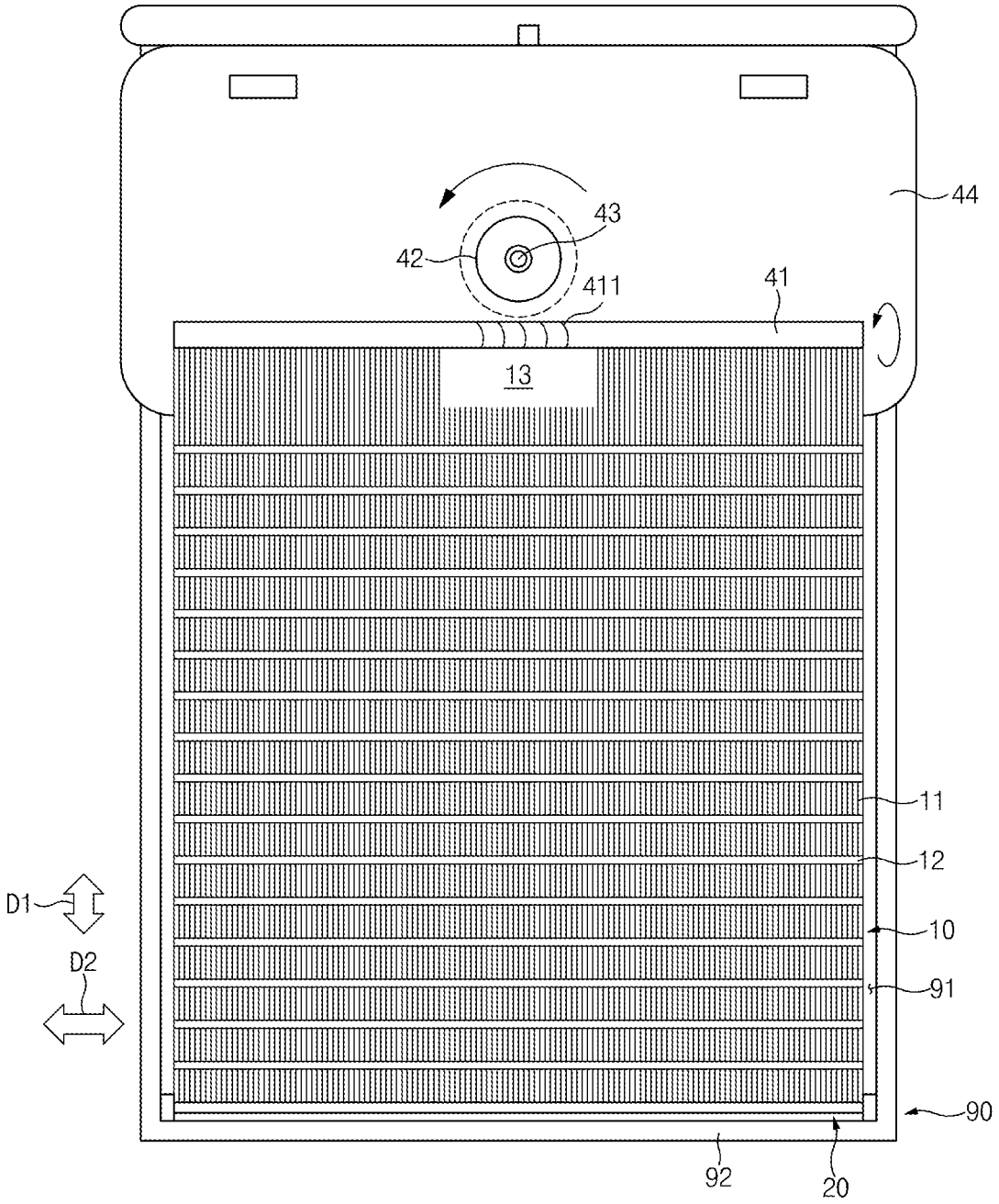
FIG. 7 is a longitudinal sectional view of the curtain when viewed from the front, in the state that the blind shade is stretched after the curtain is fixed, according to the exemplary embodiment of the present invention.

FIG. 5 is a front view exemplarily illustrating the state in which the blind shade 10 is extended after the curtain 1 is fixed, according to an exemplary embodiment of the present invention. FIG. 6 is a longitudinal sectional view of the curtain 1 when viewed from the side in the state that the blind shade 10 stretched after the curtain 1 is fixed, according to the exemplary embodiment of the present invention. FIG. 7 is a longitudinal sectional view of the curtain 1 when viewed from the front in the state that the blind shade 10 is stretched after the curtain 1 is fixed, according to the exemplary embodiment of the present invention.

Referring to the drawings, according to the exemplary embodiment of the present invention, after the curtain 1 is fixed, the user rotates the knob 30 about the wheel shaft 43 to stretch and contract the blind shade 10. According to an exemplary embodiment of the present invention, the following description will be made while focusing on that the blind shade 10 is wound around the external surface of the adjusting rod 41 as the knob 30 is rotated counterclockwise as illustrated in FIG. 5, the wheel 42 is rotated in the same direction (counterclockwise), and the adjusting rod 41 is rotated in the direction corresponding to the rotation direction of the wheel 2. Although the region of the blind shade 10 adjacent to the other end portion of the blind shade 10 is wound around the external surface of the adjusting rod 41, the one end portion of the blind shade 10 linked to the base 20 is not changed in the position thereof. Accordingly, the blind shade 10 is pulled and stretched outward by the base 20 and the adjusting rod 41 in the first direction D1. As the blind shade 10 is stretched, the transmittance of light is increased.

Figure 8:
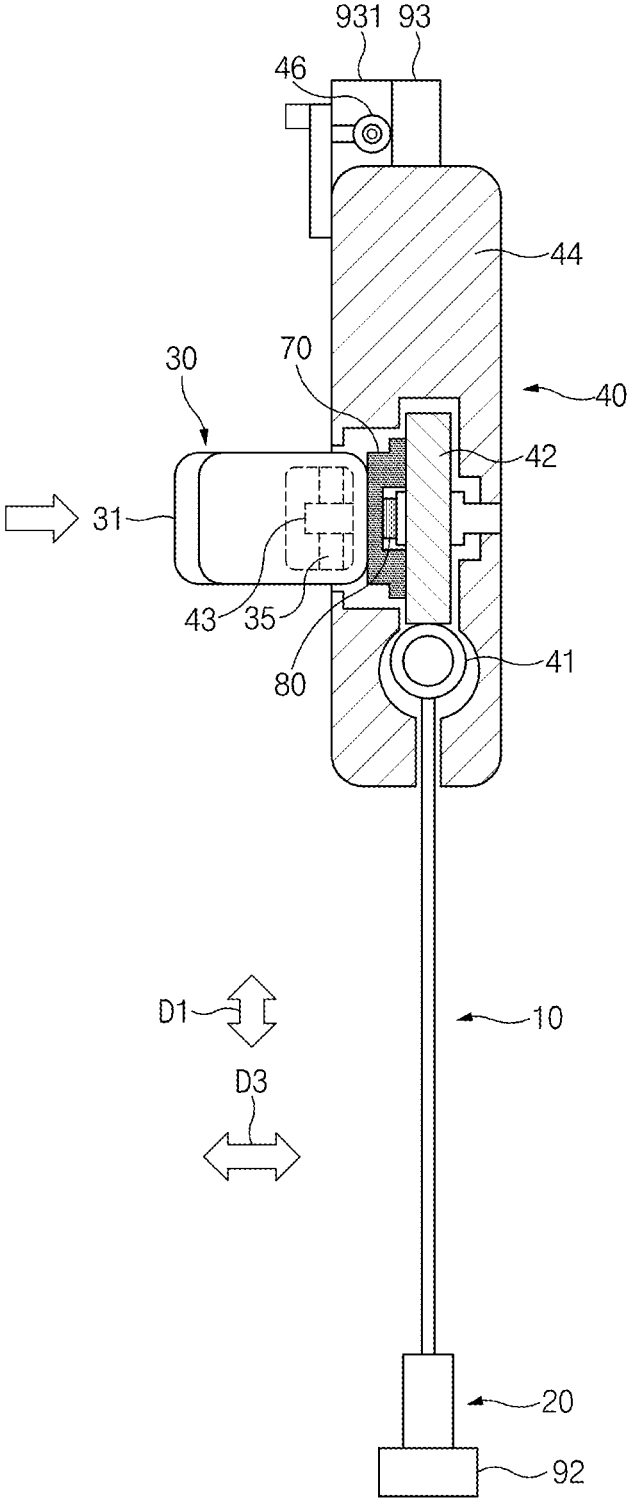
FIG. 8 is a longitudinal sectional view of the curtain when viewed from the side in the state that the blind shade is stretched and the wheel is fixed, according to an exemplary embodiment of the present invention.
Figure 9:
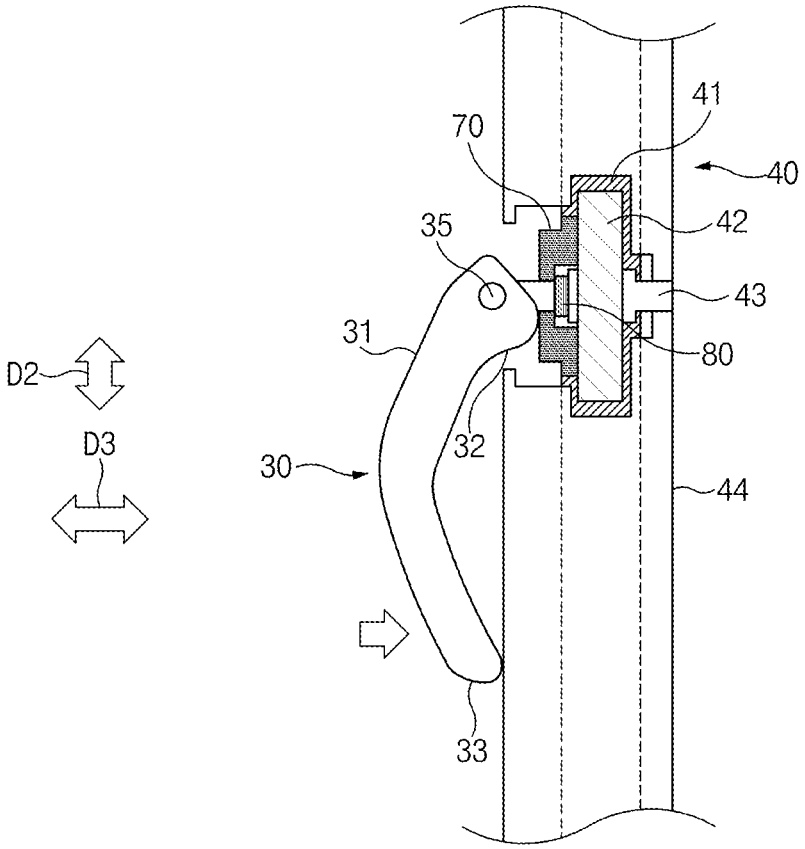
FIG. 9 is a longitudinal sectional view of the curtain 1 when viewed from the top portion in the state that the blind shade is stretched and the wheel is fixed, according to an exemplary embodiment of the present invention.

FIG. 8 is a longitudinal sectional view of the curtain 1 when viewed from the side in the state that the blind shade 10 is stretched and the wheel 42 is fixed, according to an exemplary embodiment of the present invention. FIG. 9 is a longitudinal sectional view of the curtain 1 when viewed from the top portion in the state that the blind shade 10 is stretched and the wheel 42 is fixed, according to an exemplary embodiment of the present invention.

Referring to the drawing, it may be recognized that the user presses and fixes the other end portion 33 of the knob 30 toward the wheel 42 in the third direction D3. The user rotates the knob 30 about the rotation shaft 35 of the knob 30 to rotate the wheel 42 and thus to obtain the transmittance of light by desired amount. In the instant state, the user applies external force to the knob 30 to press the knob 30.

Since the one end portion 32 of the knob 30 is formed as described with reference to FIG. 1, FIG. 2, and FIG. 3, the knob 30 is rotated about the rotation shaft 35, which is configured as a rotation axis, of the knob 30, and the boundary of the one end portion 32 of the knob 30, which is farther away from the rotation shaft 35 of the knob 30, presses the fixing portion 70. The fixing portion 70 is pressed toward the wheel 42 in the third direction D3 to make contact with the wheel 42 such that frictional force is applied to the wheel 42 to block the rotation of the wheel 42.

The return device 80 between the wheel 42 and the fixing portion 70 is compressed to apply resilience force to the fixing portion 70. Even if the resilience force, which is outward applied in the third direction D3 by the return device 80, is transmitted to the knob 30 through the fixing portion 70, the shape in the one end portion 32 of the knob 30 allows the resilience force to press the knob 30 to rotate the knob 30 counterclockwise as illustrated in FIG. 9. However, since the other end portion 33 of the knob 30 makes contact with the adjusting device body 44 as illustrated in FIG. 9, the knob 30 does not rotate counterclockwise such that the fixing portion 70 is prevented from being separated from the wheel 42.

When the user rotates the body 31 of the knob 30 in a direction opposite to the rotation direction when the fixing portion 70 is pressed, the pressure of the knob 30 applied to the fixing portion 70 is released and the position of the fixing portion 70 returns to a basic position thereof through the resilience force applied to the fixing portion 70 by the return device 80. Furthermore, since the return device 80 may be a torsion spring, the wheel shaft 43 may rotate to return to the basic position thereof through the resilience force applied to the wheel shaft 43 by the return device 80. As the wheel shaft 43 rotates, the wheel 42 connected to the wheel shaft 43 and the knob 30 rotate to return to original states thereof.

As described above, there may be provided the curtain for adjusting the transmittance of light by simply handling the curtain without the excessive increase in costs.

Although an exemplary embodiment of the present invention has been described in that all components are integrated into one portion or function as one portion, the present invention is not limited thereto. In other words, one or more components may be selectively combined with each other to operate within the scope of the present invention. Furthermore, the terms such as "comprise", "have", or "include" refers to the presence of a relevant component unless specified otherwise, and may be interpreted as further including another component without excluding the another component. Unless otherwise defined herein, all the terms used herein, which include technical or scientific terms, may have the same meaning which is generally understood by a person skilled in the art. It will be further understood that terms used herein may be interpreted as having a meaning which is consistent with their meaning in the context of the present disclosure and the relevant art and will not be interpreted in an idealized or overly formal sense unless expressly so defined in an exemplary embodiment of the present invention.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A curtain apparatus comprising:

a blind shade stretchable or contractible in a first direction to adjust transmittance of light;

a base coupled to a first end portion of the blind shade in the first direction thereof; and a transmittance adjusting device to adjust the transmittance of the light passing through the blind shade by pulling inward into the transmittance adjusting device or releasing outward from the transmittance adjusting device a portion of the blind shade in the first direction thereof, in a state that spacing between the base and the transmittance adjusting device is fixed in the first direction, wherein the transmittance adjusting device includes an adjusting rod extending in a second direction perpendicular to the first direction and coupled to at least a portion of a second end portion of the blind shade, wherein the transmittance adjusting device further include an adjusting device body and the adjusting rod is rotatably mounted to the adjusting device body, and wherein the adjusting rod rotates in the second direction as an axial direction thereof to pull the blind shade by winding a region of the blind shade, which is adjacent to the second end portion of the blind shade, around an external surface of the adjusting rod or to release the region adjacent to the second end portion of the blind shade wound around the external surface of the adjusting rod, wherein a thread is formed in a screw region which is partially formed on the external surface of the adjusting rod, wherein the transmittance adjusting device further includes a wheel fixed to a wheel shaft rotatably mounted to the adjusting device body and engaged with the thread formed on the external surface of the adjusting rod to rotate in a third direction perpendicular to the first direction and the second direction as an axial direction of the wheel, and wherein, as the wheel rotates, the adjusting rod rotates so that the blind shade is stretched or contracted along the first direction.

2. The curtain apparatus of claim 1, wherein the blind shade is coupled to a remaining region of the external surface of the adjusting rod except the screw region such that the blind shade is not wound around the screw region when the adjusting rod rotates.

3. The curtain apparatus of claim 1, further including:

a knob pivotally connected to a rotation shaft formed on an end of the wheel shaft of the wheel to selectively rotate the wheel such that the transmittance of the light passing through the blind shade is adjusted according to rotation of the knob.

4. The curtain apparatus of claim 3, further including:

a fixing portion slidably mounted on the wheel shaft of the wheel between the rotation shaft and the wheel through an opening formed on the fixing portion and selectively making contact with the wheel to block or allow a rotation of the wheel.

5. The curtain apparatus of claim 4, wherein the fixing portion include:

a first annular member having a first external diameter, wherein an end portion of the knob is selectively contacted to an external surface of the first annular member; and a second annular member having a second external diameter, where the first annular member is mounted to the second annular member and the second external diameter is greater than the first external diameter, wherein an external surface of the second annular member is selectively locked to a step formed in a mounting groove of the adjusting device body according to the rotation of the knob to prevent the fixing portion from being out of the adjusting device body.

6. The curtain apparatus of claim 4, wherein the knob is configured to pivotally rotate about the rotation shaft to selectively press the fixing portion by an end portion of the knob to a surface of the wheel such that the fixing portion makes contact with the surface of the wheel or is spaced from the wheel according to the rotation of the knob.

7. The curtain apparatus of claim 6, wherein the knob is configured to press the fixing portion by rotating about the rotation shaft in a direction perpendicular to the third direction as an axial direction thereof.

8. The curtain apparatus of claim 4, further including:

a return device applying an external force to the fixing portion in a direction away from the wheel such that the fixing portion is spaced from the wheel, when the external force applied to the fixing portion toward the wheel is released.

9. The curtain apparatus of claim 8, wherein the return device is disposed between the fixing portion and the wheel on the wheel shaft.

10. The curtain apparatus of claim 8, wherein the return device is elastically deformed when the fixing portion is pressed by an end portion of the knob to make contact to the wheel, to apply resilience force to the fixing portion in the direction away from the wheel.

11. The curtain apparatus of claim 4, further including:

a return device connected to the rotation shaft to apply resilience force to the rotation shaft of the wheel, such that the wheel rotates to return to an original state when external force applied to the fixing portion toward the wheel is released after the blind shade is stretched or contracted as the knob rotates in the original state that the blind shade is not stretched or contracted.

12. The curtain apparatus of claim 1, wherein the blind shade includes:

a plurality of first shading members extending in the first direction thereof, mounted in the second direction perpendicular to the first direction thereof, formed of a first extensible material, and stretched or contracted in the first direction thereof; and a plurality of second shading members extending in the second direction thereof, mounted in the first direction thereof, formed of a second extensible material, and coupled to the plurality of the first shading members while crossing the plurality of the first shading members.

13. The curtain apparatus of claim 12, wherein the plurality of first shading members include fiber formed of the first extensible material including spandex and nylon, and wherein the plurality of second shading members include fiber formed of the second extensible material including nylon.

14. The curtain apparatus of claim 1, wherein the transmittance adjusting device is configured to be movable in the first direction and is coupled to a frame ring formed in a ring shape on a door frame to fix the spacing from the base.

15. The curtain apparatus of claim 1, wherein the base includes a roller rod having an external surface coupled with one end portion of the blind shade, the roller rod around which the blind shade is wound, and wherein the blind shade is deployed as the transmittance adjusting device moves away from the base in the first direction while the blind shade is wound around the external surface of the roller rod.

* * * * *